US009835019B2

(12) United States Patent
Saponja et al.

(10) Patent No.: US 9,835,019 B2
(45) Date of Patent: Dec. 5, 2017

(54) SYSTEMS AND METHODS FOR PRODUCING FORMATION FLUIDS

(71) Applicant: 1784237 ALBERTA LTD., Calgary (CA)

(72) Inventors: Jeff Saponja, Calgary (CA); Colin Flanagan, Calgary (CA); Rob Hari, Calgary (CA)

(73) Assignee: Heal Systems LP, Calgary (CA)

( * ) Notice: Subject to any disclaimer, the term of this patent is extended or adjusted under 35 U.S.C. 154(b) by 145 days.

(21) Appl. No.: 14/223,738

(22) Filed: Mar. 24, 2014

(65) Prior Publication Data

US 2015/0267523 A1 Sep. 24, 2015

(51) Int. Cl.
*E21B 43/34* (2006.01)

(52) U.S. Cl.
CPC ..... *E21B 43/34* (2013.01)

(58) Field of Classification Search
USPC ..... 166/369, 372
See application file for complete search history.

(56) References Cited

U.S. PATENT DOCUMENTS

| | | | | |
|---|---|---|---|---|
| 2,624,410 | A * | 1/1953 | Nixon | E21B 43/18 166/105 |
| 4,482,364 | A * | 11/1984 | Martin | B01D 19/0031 96/188 |
| 5,488,993 | A | 2/1996 | Hershberger | 166/372 |
| 5,547,021 | A | 8/1996 | Raden | 166/250.07 |
| 5,603,826 | A | 2/1997 | Welch | 210/195.1 |
| 5,899,273 | A | 5/1999 | Jung | 166/370 |
| 5,992,521 | A * | 11/1999 | Bergren | E21B 43/385 166/105.5 |
| 6,173,768 | B1 | 1/2001 | Watson | 166/68 |
| 6,343,653 | B1 | 2/2002 | Mason et al. | 166/312 |
| 6,854,518 | B1 | 2/2005 | Senyard, Sr. et al. | 166/372 |
| 6,962,199 | B1 * | 11/2005 | Tjeenk Willink | B01D 45/16 166/177.2 |
| 7,063,161 | B2 | 6/2006 | Butler et al. | 166/372 |
| 7,717,182 | B2 | 5/2010 | Butler et al. | 166/372 |
| 2009/0120638 | A1 * | 5/2009 | Shaw | E21B 43/38 166/265 |
| 2012/0238793 | A1 * | 9/2012 | Cullinane | B01D 19/0036 585/833 |
| 2013/0193081 | A1 * | 8/2013 | Vasiliu | B01F 3/04503 210/760 |

FOREIGN PATENT DOCUMENTS

| | | |
|---|---|---|
| GB | 2450565 | 12/2008 |
| GB | 2450565 A | 12/2008 |

OTHER PUBLICATIONS

International Search Report and Written Opinion for PCT/CA2015/000177, dated Jun. 15, 2015.

(Continued)

*Primary Examiner* — Angela M DiTrani
(74) *Attorney, Agent, or Firm* — Ridout & Maybee LLP

(57) ABSTRACT

A system for producing formation fluids including an apparatus for effecting production, from a subterranean formation, of a produced formation fluid including a liquid component and a gas component. The system also includes an apparatus configured for energizing produced formation fluid using a Venturi effect to produce an energized formation fluid.

6 Claims, 2 Drawing Sheets

(56) References Cited

OTHER PUBLICATIONS

Beg, Najam. "The Applications of Surface Jet Pump Technology to Increase Oil and Gas Production," *Caltec*, 2011.
International Preliminary Report on Patentability for PCT Application No. PCT/CA2015/000177, dated Sep. 27, 2016.
Office Action dated Aug. 8, 2017 for corresponding U.S. Appl. No. 15/128,884, United States.

* cited by examiner

SYSTEMS AND METHODS FOR PRODUCING FORMATION FLUIDS

FIELD

The present disclosure relates to production of formation fluids, and systems and methods for optimizing rates of production of formation fluids.

BACKGROUND

An opportunity exists for increasing production and reserves from wells. Government regulations have been introduced requiring companies to conserve producing oil well solution gas, and this has resulted in a gas gathering system that imposes a back pressure to the wells. Any back pressure to a well will result in a higher producing bottom-hole pressure and therefore less drawdown. Less drawdown results in less production and reserves.

A field-wide back pressure reduction can significantly benefit production.

Existing pipelines and facilities impose a back pressure to the producing wells. Any length of a pipeline imposes a pressure drop due to fluid flow friction. At gathering satellites and a main battery, surface processing equipment also add back pressure. A battery's process of separating gas, water and oil can add significant back pressure. During the early phase of a producing field, higher reservoir pressures generally allow for acceptance of back pressures. As the producing field depletes, back pressure to the wells becomes more relevant for maximizing economic reservoir recoveries.

To reduce back pressure, facilities modifications have typically included adding of larger separators and adding of more compression capacity. These are generally costly modifications and are often not economically justifiable or viable.

SUMMARY

In one aspect, there is provided a system for producing formation fluids and separating the produced formation fluids into a liquid-rich separated fluid fraction and a gas-rich separated fluid fraction, comprising:

- a formation fluid conducting apparatus, disposed in a wellbore, for effecting production of formation fluid from a subterranean formation to the surface;
- a gas-liquid separator including an inlet and a motive fluid supply outlet;
- an eductor fluidly coupled to the formation fluid conducting apparatus and configured to;
  - (i) generate a suction pressure by motive fluid being conducted through the eductor, the suction pressure being sufficient to induce flow of the produced formation fluid into the suction inlet;
  - (ii) effect mixing of the introduced formation fluid with the high pressure motive fluid within the eductor to produce a fluid mixture; and
  - (iii) effect discharging of the fluid mixture from the eductor through the fluid mixture outlet;
- wherein the fluid mixture outlet is fluidly coupled to the inlet of the gas-liquid separator for supplying the fluid mixture to the gas-liquid separator;
- and wherein the motive fluid supply outlet is fluidly coupled to the eductor for supplying the motive fluid from the gas-liquid separator to the eductor.

In another aspect, there is provided a system for producing formation fluids and separating the produced formation fluids into a liquid-rich separated fluid fraction and a gas-rich separated fluid fraction, comprising:

- a formation fluid conducting apparatus, disposed in a wellbore, for effecting production of formation fluid from a subterranean formation;
- a gas-liquid separator; and
- an apparatus configured for pressurizing the produced formation fluid to a predetermined pressure using a Venturi effect, for supplying to the gas-liquid separator.

In a further aspect, there is provided a process for producing formation fluids and separating the produced formation fluids into a liquid-rich separated fluid fraction and a gas-rich separated fluid fraction, comprising:

- producing formation fluid from a reservoir;
- conducting the produced formation fluid through a wellhead;
- pressurizing the produced formation fluid using the Venturi effect to produce a pressurized fluid mixture;
- supplying the pressurized fluid mixture to a gas-liquid separator;
- separating, within the gas-liquid separator, the pressurized fluid mixture into a gas-rich separated fluid fraction and a liquid-rich separated fluid fraction; and
- recycling a fraction of the liquid-rich separated fluid fraction as a motive fluid for effecting the Venturi effect.

In yet a further aspect, there is provided a process for producing formation fluids and separating the produced formation fluids into a liquid-rich separated fluid fraction and a gas-rich separated fluid fraction, comprising:

- producing formation fluid from a reservoir;
- conducting the produced formation fluid through a wellhead;
- pressurizing the produced formation fluid using the Venturi effect to produce a pressurized fluid mixture at a predetermined pressure;
- supplying the pressurized fluid mixture to a gas-liquid separator; and
- separating, within the gas-liquid separator, the pressurized fluid mixture into a gas-rich separated fluid fraction and a liquid-rich separated fluid fraction.

In another aspect, there is provided a process for producing formation fluids and separating the produced formation fluids into a liquid-rich separated fluid fraction and a gas-rich separated fluid fraction, comprising:

- (a) producing formation fluid from a reservoir;
- (b) conducting the produced formation fluid through a wellhead;
- (c) separating, within the gas-liquid separator, the produced formation fluid from the wellhead into a gas-rich separated fluid fraction and a liquid-rich separated fluid fraction;
- (d) suspending production of the formation fluid in response to sensing of a low reservoir pressure;
- (e) retrofitting the system with an eductor, the eductor including a fluid passage for flowing produced formation fluid being conducted from the wellhead to the gas-liquid separator;
- (f) restarting production of formation fluid from the reservoir;
- (g) conducting the produced formation fluid through the wellhead;
- (h) pressurizing the produced formation fluid using the Venturi effect to produce a pressurized fluid mixture;

(i) supplying the pressurized fluid mixture to a gas-liquid separator; and (j) separating, within the gas-liquid separator, the pressurized fluid mixture into a gas-rich separated fluid fraction and a liquid-rich separated fluid fraction.

In another aspect, there is provided a process for designing a system for producing formation fluids and separating the produced formation fluids, within a gas-liquid separator, into a liquid-rich separated fluid fraction and a gas-rich separated fluid fraction, comprising:

selecting a predetermined operating pressure for the gas-liquid separator;

designing an eductor, for receiving formation fluid, pressurizing the received formation fluid to generate a pressurized fluid mixture, and supplying the pressurized fluid mixture to the gas-liquid separator, wherein the designing of the eductor 26 is based upon the selection of the predetermined operating pressure of the gas-liquid separator.

In another aspect, there is provided a system for producing formation fluids, comprising:

a formation fluid conducting apparatus, disposed within a wellbore, for effecting production, from a subterranean formation, of a liquid-rich formation fluid fraction and a gas-rich formation fluid fraction, the apparatus including a first conduit for conducting the liquid-rich formation fluid fraction to the surface and a second conduit for conducting the gas-rich formation fluid fraction to the surface, such that the produced formation fluid includes the liquid-rich formation fluid fraction and the gas-rich formation fluid fraction; and an apparatus configured for energizing produced formation fluid using a Venturi effect to produce an energized formation fluid.

In a further aspect, a process for producing formation fluids comprising:

conducting formation fluid into a wellbore from a subterranean formation;

separating, within the wellbore, from formation fluid that has been conducted into the wellbore from the subterranean formation, a liquid-rich formation fluid fraction and a gas-rich formation fluid fraction;

producing the formation fluid from the wellbore, wherein the producing includes:

conducting the liquid-rich formation fluid fraction to the surface through a first conduit such that the liquid-rich formation fluid fraction is produced from the wellbore; and conducting the gas-rich formation fluid fraction to the surface through a second conduit such that the gas-rich formation fluid fraction is produced from the wellbore;

such that the produced formation fluid includes the produced liquid-rich formation fluid and the produced gas-rich formation fluid; and pressurizing the produced formation fluid using the Venturi effect to produce a pressurized fluid mixture.

DETAILED DESCRIPTION

Figure 1:
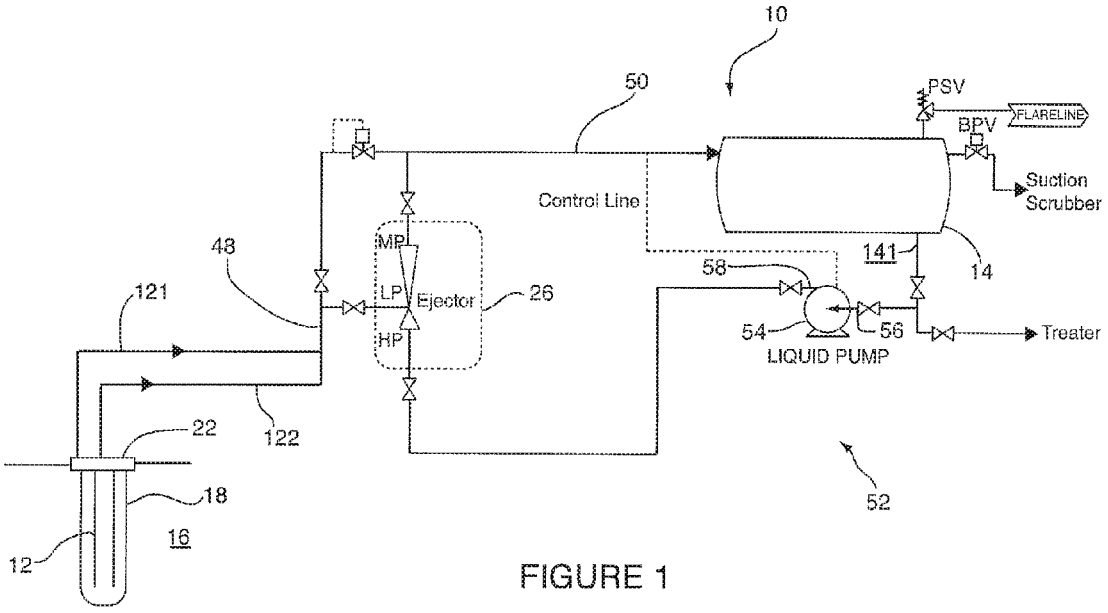
FIG. 1 is a process flow diagram of an embodiment of a system of the present disclosure.

Referring to FIG. 1, there is provided a system 10 for producing formation fluids and separating the produced formation fluids into a liquid-rich separated fluid fraction and a gas-rich separated fluid fraction.

The system includes a formation fluid conducting apparatus 12 and a gas-liquid separator 14.

The formation fluid conducting apparatus 12 produces formation fluids from a subterranean formation 16, such as a reservoir. In this respect, the formation fluid conducting apparatus 12 includes a conduit for conducting formation fluid from the subterranean formation 16 to a position above the earth's surface. The produced formation fluid includes a mixture of liquid material and gaseous material. In some embodiments, for example, the produced formation fluid includes liquid and gaseous hydrocarbons, such as oil and natural gas. In some embodiments, other liquid or gaseous materials can be present, such as water. The gas-liquid separator functions to effect separation of at least a fraction of the produced formation fluid into a gas-rich separated fluid fraction and a liquid-rich separated fluid fraction.

The formation fluid conducting apparatus 12 is disposed in a wellbore 18 that penetrates the subterranean formation 16 of interest.

In some embodiments, for example, the formation fluid conducting apparatus may include one or more artificial lift apparati for at least contributing to effecting of the production of formation fluids. An artificial lift apparatus is particularly useful when the reservoir pressure is insufficient, on its own, to provide a driving force to effect production of the formation fluids at an economically attractive rate. Suitable artificial lift apparati include a downhole pumping apparatus and a gas lift apparatus. In some embodiments, for example, the gas lift apparati includes a conduit that extends downhole and is fluidly coupled to the source of gaseous material and is configured to conduct the supplied gaseous material downhole to admix with the formation fluid that is entering or flowing into the wellbore, and thereby effect production of formation fluid-comprising mixture having a reduced density relative to the formation fluid. Such reduction in density renders it less difficult to produce the formation fluid The gas-liquid separator 14 is fluidly coupled to the formation fluid conducting apparatus 12, such as, for example, via conduit 48, through a wellhead 22. In this respect, the gas-liquid separator is configured to receive the formation fluids being produced by the formation fluid conducting apparatus 12. In some embodiments, for example, the produced formation fluid may be subjected to intermediate processing prior to being supplied to the gas-liquid separator 14. In some embodiments, for example, the intermediate processing may be effected at a satellite battery, and may include separating of some of the liquid component from the produced formation fluids. In some embodiments, for example, the intermediate processing may include effecting a reduction in pressure of the produced formation fluids, such as by using a choke manifold system. In some embodiments, for example, the intermediate processing may include extracting excess gas (such as by flaring off of excess gas) from the produced formation fluids. In any case, even when subjected to intermediate processing, the material resulting from such intermediate processing, and supplied to the gas-liquid separator 14, is "at least a fraction" of the produced formation fluid.

In some embodiments, for example, the gas-liquid separator 14 is included with other surface equipment within a multi-well battery. In this respect, in some embodiments, for example, the gas-liquid separator 14 can be configured to receive formation fluid that is produced from multiple wells, the production from each one of the wells being effected by a respective formation fluid conducting apparatus. The produced formation fluid, from multiple wells, is collected by a manifold that is fluidly coupled to the gas-liquid separator for delivery the produced formation fluid from multiple wells.

At least a fraction of the liquid-rich separated fluid fraction is conducted to and collected within storage tanks disposed within the battery. In some embodiments, for example, prior to being collected within the storage tanks, the liquid-rich separated fluid fraction can be further processed, such as, for example, to remove water, and thereby provide a purified form of hydrocarbon product. In some embodiments, for example, prior to being collected within the storage tank, the liquid-rich separated fluid fraction can be further processed, such as, for example, to remove natural gas liquids from the separated gas phase, and thereby provide a purified form of hydrocarbon product. The separated liquid rich material that is collected within the storage tank can be subsequently conducted to a predetermined location using a pipeline, or can be transported by truck or rail car.

At least a fraction of the gas-rich separated fluid fraction can also be recovered. For example, gas-rich separated fluid fraction may contain natural gas and other gaseous hydrocarbons, in which case, such gas-rich separated fluid fraction can be conducted to a pipeline or a local collection facility. Alternatively, such gas-rich separated fluid fraction can be compressed at the battery facility and stored in a suitable pressure vessel.

Figure 2:
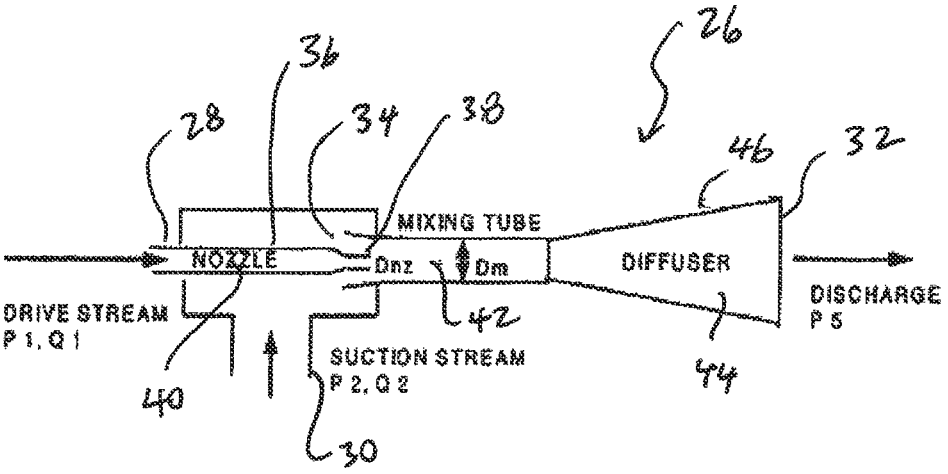
FIG. 2 is a schematic illustration of an eductor (or ejector) of an embodiment of a system of the present disclosure.

Even with embodiments of the system 10 including one or more artificial lift apparati, the rate of production of formation fluids may be insufficient, or the existing surface equipment may be inefficient. In this respect, there is provided an apparatus configured for energizing the produced formation fluid to a predetermined pressure using a Venturi effect, for supplying to the gas-liquid separator. In some embodiments, for example, the energizing includes pressurizing. Such apparatus is provided to assist in effecting production of the formation fluids. In some embodiments, for example, such apparatus may include an eductor 26 (also known as an "ejector" or "jet pump"). Referring to FIG. 2, the eductor 26 includes a motive fluid inlet 28, a suction fluid inlet 30, and a fluid mixture outlet 32. The motive fluid inlet 28, the suction fluid inlet 30, and the fluid mixture outlet 32 are fluidly coupled to one another by an eductor fluid passage 34 within the eductor. The eductor 26 is configured to: (i) generate a suction pressure by conducting motive fluid (received by the motive fluid inlet 28) through the eductor fluid passage 34, the suction pressure being sufficient to induce flow of the produced formation fluid into the suction inlet 30 (such phenomenon being known as the "Venturi effect"), (ii) effect mixing of the formation fluid with the high pressure motive fluid to produce a fluid mixture, and (iii) effect discharging of the fluid mixture through the fluid mixture outlet 32 at a pressure greater than the suction pressure.

Figure 3:
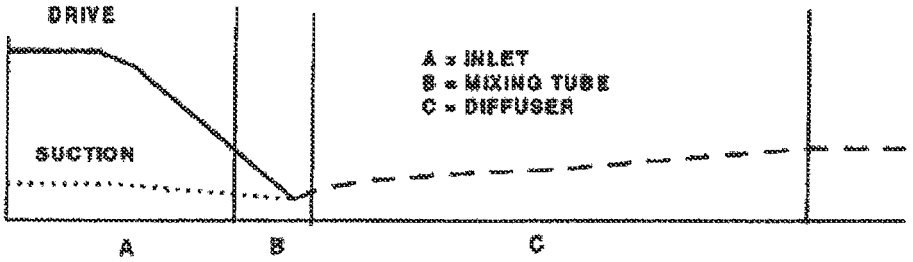
FIG. 3 is a pressure profile of the eductor (or ejector) of FIG. 2, while motive fluid is being conducted through the inductor to induce flow of another fluid through the suction inlet.

FIG. 2 illustrates an embodiment of an eductor 26, and the material flows expected when the eductor 26 is incorporated within the system 10 of the present disclosure. The motive fluid inlet 28 receives the motive fluid, and, in the illustrated embodiment, is defined within a nozzle 36. The nozzle 36 includes a nozzle outlet 38, fluidly coupled to the nozzle inlet 28 with a nozzle fluid passage 40. The nozzle outlet 38 discharges into a mixing zone 42 having a cross-sectional area that is smaller than that of the nozzle inlet 28. By flowing the motive fluid from the nozzle inlet 28 to the mixing zone 40, pressure of the motive fluid decreases and, concomitantly, the motive fluid is accelerated. By virtue of the pressure decrease, a suction pressure is generated at the suction inlet 30 which is sufficient to induce flow of the produced formation fluid through the suction inlet 30 and into the mixing zone 42. The introduced formation fluid is admixed with the motive fluid within the mixing zone 42 to produce an admixed flow (of the fluid mixture) which is then conducted from the mixing zone 42 to the fluid mixture outlet 32. The fluid mixture outlet 32 has a cross-sectional area that is larger than the cross-sectional area within the mixing zone 42, such that, at the fluid mixture outlet 32, the fluid mixture is disposed at a higher pressure, and is being flowed at a lower flowrate, relative to the fluid mixture disposed within the mixing zone 42. In some embodiments, for example, prior to being discharged from the fluid mixture outlet 32, the fluid mixture is conducted through a diffuser zone 44 (of a diffuser section 46 of the eductor 26) whose fluid passage portion is defined by an increasing cross-sectional area along its axis in a direction towards the fluid mixture outlet. As the fluid mixture is being conducted through the diffuser zone 44 towards the fluid mixture outlet 32, pressure of the fluid mixture is increasing and volumetric flowrate of the fluid mixture is decreasing. A pressure profile within the eductor 26 is illustrated in FIG. 3.

The fluid mixture, including produced formation fluid, is discharged at a pressure that is higher than the suction pressure at the suction inlet 30 of the eductor 26. In some embodiments, for example, the pressure is sufficiently high such that efficient separation of a gas-rich separated fluid fraction and a liquid-rich separated fluid fraction from the fluid mixture is promoted within the separator 14. Advantageously, efficiency in separating gaseous material from liquid material within the gas-liquid separator 14, in cases where the separation within the gas-liquid separator 14 is based on, at least, gravity (and the efficiency of the separation is, therefore, based on the available residence time for the fluid mixture within the gas-liquid separator 14), increases as higher pressure produced formation fluid is supplied to the gas-liquid separator 14.

Separation of gaseous material from liquid material in a gas-liquid separator 14 may be effected by application of gravitational forces. Gas tends to rise to the top side of the separator and liquids tend to fall to the bottom of the separator. The efficiency of a gas-liquid separator 14, in separating gaseous material from liquid material, is proportional to the volumetric flow rate of the fluid (mixture of gaseous material and liquid material) being supplied to the separator, the rheological properties of the liquid material, and the internal pressure in the separator 14.

Turbulence increases with the volumetric flow rate of fluid being separated. Turbulence interferes with gravity separation. Accordingly, increasing the volumetric flowrate of the fluid being supplied to the gas-liquid separator 14 reduces the efficiency of separation within the gas-liquid separator.

Rheological properties of the liquid material component of the fluid also affects separation efficiency within the separator. The rate at which gas bubbles rise within the separator 14 depends on the viscosity of the liquid material through which the gas bubbles are rising. The rate at which gas bubbles rise is slower in higher viscosity liquids. In this respect, with everything else being equal, separation efficiency is relatively lower in systems with higher viscosity liquids.

Operating pressure within the separator 14 also affects separation efficiency. As operating pressure increases within the separator, gaseous material within the available volume becomes more compressed. By compressing the gaseous material, velocities of gaseous and liquid material become reduced. Velocity reduction results in an increased residence time for the gaseous and liquid materials within the separator 14, and also reduces interference of rising gas bubbles with each other. Both these consequences promote increased separation efficiency.

Higher operating pressure in the separator 14 is also important for efficient transfer of gases and liquid from the separator 14 onward to the next phase of processing. If there are inlet flow conditions which are transient or slug-flowing, an ability to transfer high volumetric flow rates for short periods is important for avoiding overload of the separator (overload can be characterized as "carry-over" of liquids in the separator's exiting gas stream outlet).

In some embodiments, for example, the separator 14 may be operated near its maximum rated allowable working pressure.

The eductor 26 is disposed between, and in fluid communication with, the wellhead 22 and the gas-liquid separator 14. In this respect, the eductor 26 is fluidly coupled to the wellhead 22 through a fluid passage defined within a conduit 48. Also, the eductor 26 is fluidly coupled to the gas-liquid separator 14 by a fluid passage defined within a conduit 50.

In one aspect, the motive fluid includes a fraction of the liquid-rich separated fluid fraction that has been separated from the fluid mixture within the gas-liquid separator 14. In this respect, a motive fluid supply subsystem 52 is provided for supplying the motive fluid from the gas-liquid separator 14 to the motive fluid inlet 28 of the eductor 26. The motive fluid supply subsystem 52 includes a prime mover 54, such as a pump, that pressurizes the motive fluid and supplies the pressurized motive fluid to the motive fluid inlet 28 of the eductor 26. The prime mover 54 includes a suction 56 that is fluidly coupled to a motive fluid supply outlet 141 of the gas-liquid separator 14 for inducing flow of a fraction of the liquid-rich separated fluid fraction from the gas-liquid separator. The prime mover 54 includes a discharge 58 that is fluidly coupled to the motive fluid inlet 28 of the eductor 26, and is configured to supply pressurized motive fluid to the motive fluid inlet 28 of the eductor 26.

In another aspect, the eductor 26 is configured so as to effect production of a pressurized fluid mixture at a selected predetermined pressure, for supplying to the gas-liquid separator 14. In some embodiments, for example, the selection of the predetermined pressure is based upon, at least, both of: (i) a selected predetermined rate of production of formation fluids by the formation fluid conducting apparatus 12, and (ii) a selected predetermined separation factor for the separation of gaseous material from the pressurized fluid mixture (generated by the eductor 26 and supplied to the gas-liquid separator 14) within the gas-liquid separator 14.

The selection of the predetermined pressure is based upon, amongst other things, providing conditions for promoting efficient separation within the gas-liquid separator. As explained above, more efficient separation of gases from liquids is effected as pressure is increased. However, backpressure within the wellbore 18 increases concomitantly with increasing pressure within the gas-liquid separator, resulting in a concomitant reduction in the rate of production of formation fluids from the wellbore by the formation fluid conducting apparatus 12. Accordingly, improvement in separation efficiencies, gained by increasing of pressure within the gas-liquid separator 14, is balanced against a reduced rate of production of formation fluids by the formation fluid conducting apparatus 12, when designing the eductor 26. Exemplary features of the eductor 26 which can be specified, while designing the eductor 26, include pressure of the motive fluid and flowrate of the motive fluid. The process of generally specifying the design of an eductor is known by those of skill in the art.

In another aspect, separation, from the formation fluid that has been conducted into the wellbore 18 from the subterranean formation, of a liquid-rich formation fluid fraction and a gas-rich formation fluid fraction, is effected within the wellbore 18 by, at least, gravity separation. In some embodiments, for example, the gravity separation is effected by a downhole gas separator, such as a packer-type gas anchor or a poor boy type gas anchor. In this respect, the formation fluid conducting apparatus 12 includes a first conduit 122 including a fluid passage for conducting the liquid-rich formation fluid fraction from a subsurface location within the wellbore to above the earth's surface. The formation fluid conducting apparatus 12 also includes a second conduit 121 including a fluid passage for conducting the gas-rich formation fluid fraction from a subsurface location within the wellbore 18 to above the earth's surface. The provision of the separate conduits 121, 122 is such that conducting of the liquid-rich formation fluid fraction to above the earth's surface is effected separately from the conducting of the gas-rich fluid fraction to above the earth's surface.

In some embodiments, for example, the conducting of the liquid-rich formation fluid fraction is assisted by one or more artificial lift apparati. Suitable artificial lift apparati include a downhole pump and a gas lift apparatus. Exemplary downhole pumps include sucker rod pumps. With respect to the gas lift apparatus, the gas lift apparatus includes a gaseous material-conducting conduit that is fluidly coupled to a gaseous material source above ground, and extends downhole into the wellbore for supplying the gaseous material from the gaseous material source for admixing with formation fluids disposed within the wellbore and thereby producing a density-reduced formation fluid-comprising mixture which renders production of the liquid-rich formation fluid fraction to become less difficult.

In some embodiments, for example, the liquid-rich formation fluid fraction is conducted through a production conduit disposed within the wellbore and extending to the wellhead, and the gas-rich formation fluid fraction is conducted within an annulus disposed between the production conduit and casing that is disposed within and is stabilizing the wellbore. In this respect, the first conduit includes the production conduit, and the second conduit includes the annulus.

The produced formation fluid includes the produced liquid-rich formation fluid fraction and the produced gas-rich formation fluid fraction, and the system includes an apparatus configured for energizing the produced formation fluid using a Venturi effect to produce an energized formation fluid. In this respect, the apparatus pressurizes the produced formation fluid such the pressure of the formation fluid is increased by the eductor using the Venturi effect. By subjecting the produced formation fluid, including, in particular, the produced gas-rich formation fluid fraction, to the Venturi effect, backpressure within the wellbore 18, and in particular, the annular region which is conducting the gas-rich formation fluid to the surface.

Referring to FIG. 1, in some embodiments, for example, the apparatus includes a single eductor 26 and the produced liquid-rich formation fluid fraction is combined with the produced gas-rich formation fluid fraction to produce a produced formation fluid admixture to the eductor 26. The eductor 26 energizes the produced formation fluid admixture to produce an energized formation fluid admixture, and the energized formation fluid admixture is supplied to the gas-liquid separator 14. In some embodiments, for example, after being produced from the wellbore 18, but prior to being supplied to the eductor 26, the produced gas-rich formation portion is energized by a compressor (i.e. pressurized or compressed by the compressor).

In some embodiments, for example, the apparatus includes at least two eductors. At least one eductor is dedicated to energizing the produced liquid-rich formation fluid fraction to produce an energized liquid-rich formation fluid fraction portion. At least one eductor is dedicated to energizing the produced gas-rich formation fluid fraction to produce an energized gas-rich formation fluid fraction portion. The energized portions are then combined and supplied to the separator 14.

A process embodiment, that is manifested while operating the above-described system, will now be described. Formation fluid is produced from a wellbore 18 and conducted to the surface through the wellhead 22. The produced formation fluid is induced to mix with a motive fluid within an eductor 26 to produce a pressurized fluid mixture. The pressurized fluid mixture is supplied to a gas-liquid separator 14 to effect separation of the fluid mixture into a gas-rich separated fluid fraction and a liquid-rich separated fluid fraction. In some embodiments, for example, a fraction of the liquid-rich separated fluid fraction is recycled as the motive fluid that is flowed through the eductor 26. In some embodiments, for example, the operating pressure within the gas-liquid separator 14 is predetermined by selection, and this dictates the pressure at which the pressurized fluid mixture is generated by the eductor 26 and supplied to the gas-liquid separator 14. The predetermined pressure is selected based upon efficient gas-liquid separation within the gas-liquid separator 14, while also enabling an economically acceptable rate of production of formation fluids by the formation fluid conducting apparatus 12. In this respect, the predetermined pressure is selected based upon, at least, both of: (i) a selection of a predetermined rate of production of formation fluids by the formation fluid conducting apparatus 12, and (ii) a selection of a predetermined separation factor for the separation of gaseous material from the pressurized fluid mixture (generated by the eductor 26 and supplied to the gas-liquid separator 14) within the gas-liquid separator 14.

In another embodiment, another system for producing formation fluids and separating the produced formation fluids into liquids and gaseous components is provided. The system includes a formation fluid conducting apparatus 12 and a gas-liquid separator 14, but does not include an eductor 26. In a process implementation of the system, formation fluids are produced from a wellbore 18 and conducted through a wellhead 22 to a gas-liquid separator 14, and the formation fluids are then separated into a gas-rich separated fluid fraction and a liquid-rich separated fluid fraction within the gas-liquid separator 14. When a low pressure reservoir condition is sensed, the production of the formation fluids is suspended. After the suspension of the production, the system is retrofitted with an eductor 26 (as described above) such that the system is transformed into the system 10.

In another aspect, there is provided a method of designing a system for producing formation fluids. In this respect, the method includes designing an eductor 26. As explained above, the eductor 26 is configured to assist in effecting production of the formation fluids, and is disposed for receiving produced formation fluids from the formation fluid conducting apparatus 12. The eductor 26 is designed to effect production of a pressurized fluid mixture at a selected predetermined pressure, for supplying to the gas-liquid separator 14 (for example, through the fluid passage of the conduit 50). The selection of the predetermined pressure is based on, at least, both of: (i) selection of a predetermined rate of production of formation fluids by the formation fluid conducting apparatus 12, and (ii) selection of a separation factor for the separation of gaseous material from the pressurized fluid mixture within the gas-liquid separator 14. In this respect, prior to designing the eductor 26, a predetermined pressure within the gas-liquid separator 14 is selected.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A process for producing formation fluids comprising:

conducting subterranean formation fluid into a wellbore from a subterranean formation; separating, within the wellbore, from subterranean formation fluid that has been conducted into the wellbore from the subterranean formation, a liquid-rich formation fluid fraction and a gas-rich formation fluid fraction;

conducting the liquid-rich formation fluid fraction to the surface through a first conduit such that a produced liquid-rich formation fluid fraction is produced from the wellbore;

conducting the gas-rich formation fluid fraction to the surface through a second conduit such that a produced gas-rich formation fluid fraction is produced from the wellbore;

combining the produced liquid-rich formation fluid fraction and the produced gas-rich formation fluid fraction to obtain a produced formation fluid;

pressurizing a motive fluid with a prime mover such that a pressurized motive fluid is produced; supplying the pressurized motive fluid to an eductor;

generating a suction pressure by conducting the pressurized motive fluid through the eductor, the suction pressure being sufficient to induce flow of the produced formation fluid into a suction inlet of the eductor;

effecting mixing of the produced formation fluid, received by the suction inlet, with the pressurized motive fluid within the eductor to produce a pressurized fluid mixture;

discharging the pressurized fluid mixture from the eductor at a pressure that is greater than the pressure of the produced formation fluid being introduced into the suction inlet of the eductor;.

supplying the pressurized fluid mixture to a gas-liquid separator; and separating, within the gas-liquid separator, the pressurized fluid mixture into a gas-rich separated fluid fraction and a liquid-rich separated fluid fraction.

2. The process as claimed in claim 1;

wherein the separating, within the wellbore, from the subterranean formation fluid that has been conducted into the wellbore from the subterranean formation, a liquid-rich formation fluid fraction and a gas rich formation fluid fraction, is effected based on, at least, gravity separation.

3. The process as claimed in claim 1;

wherein the producing of at least the liquid-rich formation fluid fraction is assisted by an artificial lift operation.

4. The process as claimed in claim 1;

wherein the separating within the gas-liquid separator is effected based on, at least, gravity separation.

5. The process as claimed in claim 1;

wherein the pressurized fluid mixture is produced at a predetermined pressure and the predetermined pressure is selected based upon, at least, both of: (i) selection of a predetermined rate of production of formation fluids, and (ii) selection of a predetermined separation factor for the separation of gaseous material from the pressurized fluid mixture within the gas-liquid separator.

6. The process as claimed in claim 1, further comprising:

recycling a fraction of the liquid-rich separated fluid fraction as the motive fluid.

* * * * *